US008032065B2

(12) United States Patent
Furuya

(10) Patent No.: US 8,032,065 B2
(45) Date of Patent: Oct. 4, 2011

(54) DEVELOPING DEVICE AND IMAGE FORMING APPARATUS

(75) Inventor: Satoru Furuya, Tokyo (JP)

(73) Assignee: Oki Data Corporation, Tokyo (JP)

( * ) Notice: Subject to any disclaimer, the term of this patent is extended or adjusted under 35 U.S.C. 154(b) by 441 days.

(21) Appl. No.: 12/320,238

(22) Filed: Jan. 22, 2009

(65) Prior Publication Data

US 2009/0214272 A1 Aug. 27, 2009

(30) Foreign Application Priority Data

Feb. 26, 2008 (JP) ..... 2008-044077

(51) Int. Cl.
*G03G 15/08* (2006.01)

(52) U.S. Cl. ..... 399/286; 399/281

(58) Field of Classification Search ..... 399/279, 399/281, 286
See application file for complete search history.

(56) References Cited

U.S. PATENT DOCUMENTS

| | | | | |
|---|---|---|---|---|
| 6,512,911 | B2 * | 1/2003 | Arai et al. | 399/286 |
| 6,714,754 | B2 * | 3/2004 | Ozeki et al. | 399/286 |
| 7,912,411 | B2 * | 3/2011 | Takagi et al. | 399/286 |

FOREIGN PATENT DOCUMENTS

| | | |
|---|---|---|
| JP | 04-204675 | 7/1992 |
| JP | 08-220874 | 8/1996 |
| JP | 10-083116 | 3/1998 |
| JP | 11-202614 | 7/1999 |
| JP | 2002-162774 | 6/2002 |
| JP | 2004-233973 | 8/2004 |
| JP | 2005-186323 | 7/2005 |
| JP | 2006-243358 | 9/2006 |

* cited by examiner

*Primary Examiner* — Hoang Ngo
(74) *Attorney, Agent, or Firm* — Kubotera & Associates, LLC

(57) ABSTRACT

A developing device includes a developer supporting member for supporting developer and a developer charging member disposed to face the developer supporting member for charging and supplying the developer to the developer supporting member. The developer supporting member has a surface having a calculated average surface roughness Ra between 0.1 μm and 0.6 μm and a surface free energy SFE between 15 mN/m and 26 mN/m. Further, the developer charging member has an Asker F hardness Haf between 24° and 56°.

10 Claims, 6 Drawing Sheets

DEVELOPING DEVICE AND IMAGE FORMING APPARATUS

BACKGROUND OF THE INVENTION AND RELATED ART STATEMENT

The present invention relates to a developing device and an image forming apparatus having the developing device.

In a conventional image forming apparatus of an electrophotography type such as a printer, a facsimile, a copier, and the likes, a charging roller uniformly charges a surface of a photosensitive drum, and an exposure device exposes the surface of the photosensitive drum to form a static latent image thereon. After a developing device develops the static latent image to form a toner image on the photosensitive drum, a transfer roller transfers the toner image to a sheet. Then, a fixing device fixes the toner image to the sheet, thereby forming an image on the sheet.

In the conventional developing device, a developing roller is disposed to be freely rotatable and abut against the photosensitive drum for forming the toner image. Further, a toner supply roller is disposed to be freely rotatable and abut against the developing roller. A developing blade is disposed to contact with a surface of the developing roller at a distal end portion thereof. When toner as developer retained in a toner cartridge is supplied to the conventional developing device, the toner supply roller supplies toner thus supplied to the developing roller, and scrapes off toner remaining on the developing roller without being developed, i.e., undeveloped toner.

In the conventional developing device, when toner is supplied to the developing roller, the developing blade forms a thin layer of toner while the developing roller rotates. Further, toner is charged with a specific polarity, thereby forming a toner layer on the developing roller. Then, toner of the toner layer is transported to a developing portion between the developing roller and the photosensitive drum, and is attached to the static latent image on the photosensitive drum, thereby visualizing the static latent image and forming the toner image. (Refer to Patent Reference)

Patent Reference Japanese Patent Publication No. 10-83116

In the conventional printer, when the toner supply roller is not able to sufficiently scrape off undeveloped toner remaining in a recess portion of surface undulation of the developing roller, an afterimage may occur. To this end, the developing roller is configured to have less undulation. In this case, the developing roller is not capable of transporting a sufficient amount of toner, thereby reducing an image density. In other words, there is a tradeoff relation between prevention of an afterimage and obtaining a sufficient image density.

SUMMARY OF THE INVENTION

According to a first aspect of the present invention, a developing device includes a developer supporting member for supporting developer and a developer charging member disposed to face the developer supporting member for charging and supplying the developer to the developer supporting member.

The developer supporting member has a surface having a calculated average surface roughness Ra between 0.1 μm and 0.6 μm and a surface free energy SFE between 15 mN/m and 26 mN/m. Further, the developer charging member has an Asker F hardness Haf between 24° and 56°.

In the present invention, the developing device includes the developer supporting member for supporting the developer and the developer charging member disposed to face the developer supporting member for charging and supplying the developer to the developer supporting member. The developer supporting member has the surface having the calculated average surface roughness Ra between 0.1 μm and 0.6 μm and the surface free energy SFE between 15 mN/m and 26 mN/m. Further, the developer charging member has the Asker F hardness Haf between 24° and 56°. Accordingly, it is possible to prevent an afterimage from occurring and obtain a sufficient image density.

DETAILED DESCRIPTION OF PREFERRED EMBODIMENTS

Hereunder, embodiments of the present invention will be explained with reference to the accompanying drawings. In the present invention, a printer will be explained as an image forming apparatus.

Figure 2:
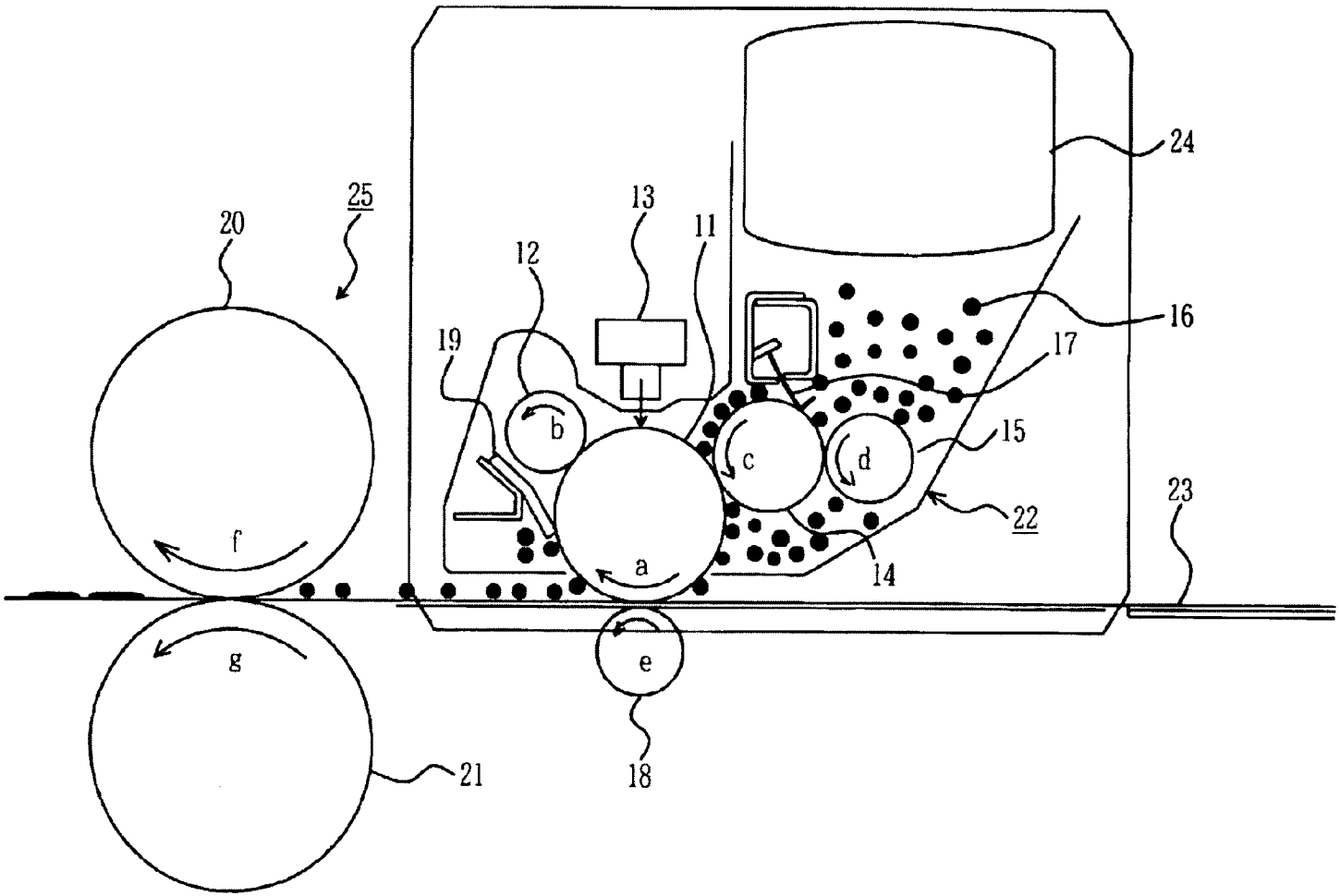
FIG. 2 is a schematic view showing an image forming unit and a fixing device of a printer according to the first embodiment of the present invention.

FIG. 2 is a schematic view showing an image forming unit and a fixing device of a printer according to the first embodiment of the present invention.

As shown in FIG. 2, the printer includes a photosensitive drum 11 with a drum shape as an image supporting member. The photosensitive drum 11 is formed of a conductive supporting member and an optical conductive layer, and is disposed to be freely rotatable in an arrow direction a. An organic photosensitive member is used as the photosensitive drum 11, and a selenium photosensitive member, a zinc oxide photosensitive member, an amorphous silicon photosensitive member, and the likes may be used instead.

In the embodiment, the printer further includes a charging roller 12 as a charging device. The charging roller 12 is formed of a metal shaft and a semi-conductive rubber layer, and is disposed to be freely rotatable in an arrow direction b following with a rotation of the photosensitive drum 11. The printer further includes an LED (Light Emitting Diode) head 13 as an exposure device disposed to face the photosensitive drum 11. The LED head 13 is formed of an LED array (not shown) and a rod lens array (not shown). Instead of the LED head 13, a combination of a laser and an image forming optical system may be used.

In the embodiment, the printer includes a developing roller 14 as a developer supporting member abutting against the photosensitive drum 11 and disposed to be freely rotatable in an arrow direction c; a toner supply roller 15 as a developer charging member or a developer supply member disposed to be freely rotatable in an arrow direction d, i.e., an opposite direction at an butting portion with the developing roller 14; toner 16 as developer; a developing blade 17 as a developer regulation member disposed to abut against the developing roller 14; a transfer roller 18 as a transfer member disposed to be freely rotatable in an arrow direction e; a cleaning blade 19 as a cleaning member; a sheet 23 as a medium; a toner cartridge 24 as a developer cartridge; and a fixing device 25 as a fixing unit.

In the embodiment, the fixing device 25 is provided with a heating roller 20 as a first roller disposed to be freely rotatable in an arrow direction f and a pressing roller 21 as a second roller disposed to be freely rotatable in an arrow direction g.

In the embodiment, the charging roller 12 and the transfer roller 18 are disposed to contact with a surface of the photosensitive drum 11. Further, the developing roller 14 bites into the photosensitive drum 11 by 0.1 mm, and the toner supply roller 15 bites into the photosensitive drum 11 by 0.1 mm. Accordingly, nip portions as bitten portions are formed between the photosensitive drum 11 and the developing roller 14, and between the developing roller 14 and the toner supply roller 15, respectively. Alternatively, the developing roller 14 may be disposed away from the photosensitive drum 11.

In the embodiment, the developing blade 17 is formed of a metal plate such as SUS having a thickness of 0.08 mm and a curved portion contacting with the developing roller 14. The curved portion has a radius of curvature of 0.18 mm and a surface roughness of 0.6 mm as a ten-point average roughness Rz.

In the embodiment, the developing roller 14, the toner supply roller 15, the developing blade 17, and the likes constitute a developing device 22. The photosensitive drum 11, the charging roller 12, the developing device 22, a cleaning device, and the likes constitute an image forming unit. When the printer is a color printer, four image forming units of yellow, magenta, cyan, and black are arranged for forming toner images in each color.

An operation of the printer will be explained next. A drum motor as a drive unit (not shown) is driven to rotate the photosensitive drum 11 at a specific circumferential speed in the arrow direction a. When a charging high voltage power source (not shown) applies a direct current voltage to the charging roller 12, the charging roller 12 uniformly charges the photosensitive drum 11. Then, the LED head 13 exposes the photosensitive drum 11 with an amount of light according to an image signal, thereby forming a static latent image as a latent image.

In the developing device 22, when a toner supply high voltage power source (not shown) applies a voltage to the toner supply roller 15, the toner 16 retained in the developing device 22 is transported along with a rotation of the toner supply roller 15, and is supplied to the developing roller 14. Then, the toner 16 is attached to the developing roller 14 and transported along with a rotation of the developing roller 14, so that the developing blade 17 forms a toner layer with a uniform thickness on a surface of the developing roller 14. Afterward, the developing roller 14 develops the static latent image to form a toner image.

In the embodiment, when a developing high voltage power source (not shown) applies a voltage to the developing roller 14, a bias voltage is generated between the developing roller 14 and the photosensitive drum 11 for performing reverse development. Further, an electric force line is generated between the developing roller 14 and the photosensitive drum 11 corresponding to the static latent image formed on the surface of the photosensitive drum 11. As a result, the toner 16 charged on the developing roller 14 is attached to the photosensitive drum 11 through a static electrical force, thereby forming the toner image.

A sheet supply roller (not shown) picks up the sheet 23 retained in a sheet-supply cassette as a medium storage unit (not shown), and the sheet 23 is transported to a stationary transport roller (not shown) to correct skew thereof. When the transport roller rotates, the sheet 23 is transported to a transfer portion formed between the photosensitive drum 11 and the transfer roller 18, so that the toner image is transferred to the sheet 23 at the transfer portion. At this moment, a transfer high voltage power source (not shown) applies a voltage to the transfer roller 18.

In the next step, the sheet 23 is transported to the fixing device 25, so that the toner image is fixed to the sheet 23. More specifically, the heating roller 20 heats the toner 16 forming the toner image to melt, and the pressing roller 21 presses the toner 16 into fibers of the sheet 23. Afterward, the sheet 23 is discharged outside the printer.

After the toner image is transferred to the sheet 23, a small amount of the toner 16 remains on the photosensitive drum 11. The cleaning blade 19 butting against the surface of the photosensitive drum 11 at the distal end portion thereof scrapes off the toner 16 thus remaining, so that the toner 16 is collected in a waste toner collection unit. The cleaning blade 19 is formed of a rubber elastic member such as a urethane elastomer.

Figure 1:
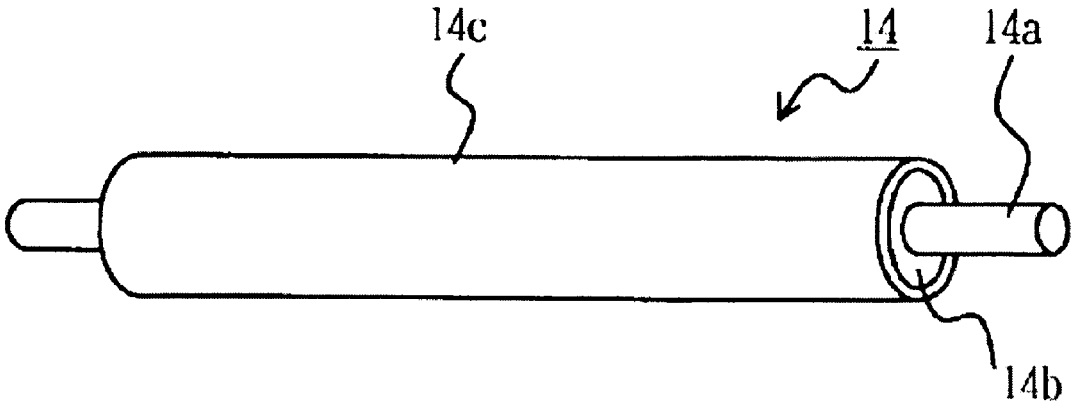
FIG. 1 is a schematic perspective view showing a developing roller according to a first embodiment of the present invention.

FIG. 1 is a schematic perspective view showing the developing roller 14 according to the first embodiment of the present invention.

As shown in FIG. 1, the developing roller 14 as a first rotational member is formed of a metal shaft 14*a* made of a metal such as SUS and an elastic layer 14*b* at an outer circumference thereof. A surface layer 14*c* is formed on an outer circumference of the elastic layer 14*b*. If necessary, it is possible to apply an adhesive, a primer, and the likes between the metal shaft 14*a* and the elastic layer 14*b* for increasing adhesion therebetween, and to apply a conductive adhesive, a conductive primer, and the likes.

In the embodiment, the elastic layer 14*b* may be formed of a material such as ethylene-propylene-diene rubber (EPDM), styrene-butadiene rubber (SBR), a silicon rubber, a polyurethane type elastomer, and the likes. If necessary, the material may contain an additive such as a conductive agent, silicone oil, and the likes. The conductive agent may include carbon black, graphite, potassium titanate, iron oxide, $TiO_2$, ZnO, $SnO_2$, and the likes.

In the embodiment, the surface layer 14*c* may be formed of a resin component such as an acrylic resin, an epoxy resin, a phenol resin, a polyester resin, a polyamide resin, a silicon resin, a urethane resin, and the likes. The resin may be modified, grafted, or block-copolymerized, and may be used alone or combined.

The resin component of the surface layer 14*c* may contain a conductive agent, a charge control agent and the likes. The charge control agent may include a quaternary ammonium salt, borate salt, an azine type (nigrosin type) compound, an azo compound, oxynaphthoic acid salt, an interfacial active agent (anionic type, cationic type, nonionic type, and the likes), and the likes. If necessary, the resin component may contain a stabilizer, an ultraviolet absorber, a reinforcement, a lubricant, a mold release, a pigment, a frame retardant, and the likes.

Figure 3:
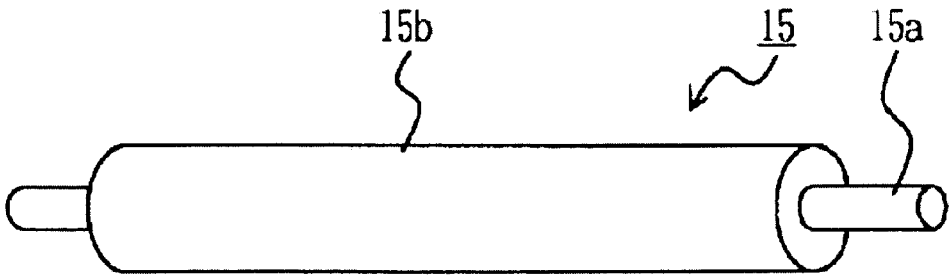
FIG. 3 is a schematic perspective view showing a toner supply roller according to the first embodiment of the present invention.

FIG. 3 is a schematic perspective view showing the toner supply roller 15 according to the first embodiment of the present invention. As shown in FIG. 3, the toner supply roller 15 as a second rotational member is formed of a metal shaft 15*a* made of a metal such as SUS and a sponge layer 15*b* or a foam layer with conductivity disposed on an outer circumference of the metal shaft 15*a*.

In the embodiment, the toner 16 is a crashed type toner having an average particle size of 5.5 μm, and is a non-magnetic one-component type with negative conductivity. A polyester resin is used as a binder thereof. Further, the toner 16 has a saturated charge amount of −44 μC/g.

A method of producing the developing roller 14 will be explained next. In the embodiment, five developing rollers A to E are produced.

Developing Roller A

The elastic layer 14*a* is formed of a silicone rubber with a low hardness and low setting. The elastic layer 14*a* of the silicone rubber is disposed on the outer circumference of the metal shaft 14*a* to from a base roller. The surface layer 14*c* is formed of a conductive compound. In producing the conductive compound, 100 wt % of a polyester polyol, 30 wt % of isocyanate, 1 wt % of a silicone-grafted-acrylic resin (a number average molecular weight: 5,000), and 30 wt % of carbon black as a conductive agent are mixed and solved in methylethylketone, thereby obtaining a coating solution with a concentration of 20 wt %.

The silicone-grafted-acrylic resin has good compatibility with the urethane, and has a low molecular weight for reducing a surface free energy. After the coating solution is coated on an outer circumference of the base roller, the base roller is heated in an oven at 170° C. for one hour for vulcanization, thereby obtaining the developing roller A.

Developing Roller B

The elastic layer 14*a* is formed with a method similar to that of the developer roller A, thereby obtaining the base roller. Then, as the conductive compound of the surface layer 14*c*, the coating solution is obtained with a method similar to that of the developer roller A, except 10 wt % of the silicone-grafted-acrylic resin (a number average molecular weight: 5,000) is used.

After the coating solution is coated on the outer circumference of the base roller, the base roller is heated in an oven at 170° C. for one hour for vulcanization, thereby obtaining the developing roller B.

Developing Roller C

The elastic layer 14*a* is formed with a method similar to that of the developer roller A, thereby obtaining the base roller.

Then, 30 wt % of a silicone polymer (KF6001, a product of Shinetsu Chemical Co., Ltd.), 44 wt % of methyl-methacrylic acid (MMA), 20 wt % of n-butyl acrylic acid (BA), and 6 wt % of 2-hydroxyl ethyl methacrylic acid (HEMA) are reacted in methylisobutylketone (MIBK) at a temperature of 100° C. for five hours while refluxing, thereby obtaining the silicone-grafted-acrylic resin (silicone block/acrylic block=30/70 weight ratio) as the conductive compound of the surface layer 14*c*. Then, 100 wt % of the silicone-grafted-acrylic resin and 20 wt % of carbon black are solved in methylethylketone, thereby obtaining a coating solution with a concentration of 20 wt %.

After the coating solution is coated on the outer circumference of the base roller, the base roller is heated in an oven at 170° C. for one hour for vulcanization, thereby obtaining the developing roller C.

Developing Roller D

The elastic layer 14*a* is formed with a method similar to that of the developer roller A, thereby obtaining the base roller. Then, as the conductive compound of the surface layer 14*c*, the coating solution is obtained with a method similar to that of the developer roller A, except 10 wt % of a silicone-grafted-acrylic resin (a number average molecular weight: 10,000) is used.

After the coating solution is coated on the outer circumference of the base roller, the base roller is heated in an oven at 170° C. for one hour for vulcanization, thereby obtaining the developing roller D.

Developing Roller E

The elastic layer 14*a* is formed with a method similar to that of the developer roller A, thereby obtaining the base roller. In producing the conductive compound of the surface layer 14*c*, 100 wt % of a polyester polyol, 30 wt % of isocyanate, and 30 wt % of carbon black as a conductive agent are mixed and solved in methylethylketone, thereby obtaining a coating solution with a concentration of 20 wt %.

After the coating solution is coated on the outer circumference of the base roller, the base roller is heated in an oven at 170° C. for one hour for vulcanization, thereby obtaining the developing roller E.

In the developing rollers A to E thus produced, the metal shaft 14*a* has a diameter of 10 mm; the elastic layer 14*b* has a thickness of 3 mm; and the surface layer 14*c* has a thickness of 10 μm. Further, the developing rollers A to E have an Asker C hardness of 61° measured with an Asker C hardness meter.

A method of producing the toner supply roller 15 will be explained next. In the embodiment, five toner supply rollers a to e are produced. The sponge layer 15*b* is formed of a polyurethane soft slab foam. The polyurethane soft slab foam is produced through reacting a polyisocyanate and a polyester type polyol while a polymerization reaction and a foaming reaction start at the same time. The polyurethane soft slab foam is obtained with an open foaming. It is possible to change a hardness of a foam through changing a foam ratio by adjusting a heating timing. The toner supply rollers a to e have difference degrees of hardness.

In the next step, the polyurethane soft slab foam is punched out with a specific punch mold. After inserted into the metal shaft 15*a*, the polyurethane soft slab foam is attached to form in a roll shape.

In this state, the sponge layer 15*b* has not have conductivity. 100 wt. % of an acrylic type latex, 50 wt. % of carbon black, and 50 wt. % of pure water are mixed to obtain a resin solution having conductivity. The sponge layer 15*b* is immersed in the resin solution and dried, thereby obtaining the toner supply rollers a to e with the sponge layer 15*b* having conductivity.

The toner supply rollers a to e have the Asker F hardness Haf of 65°, 56°, 29°, 24°, and 15° measured with an Asker F hardness meter, respectively. In the measurement, a pressing surface of the Asker F hardness meter is pressed on a side surface of the toner supply roller 15 with a load of 1,000 gf. In this case, the pressing surface is fixed to the toner supply roller 15 such that the pressing surface does not float or bite with respect to the toner supply roller 15. In the toner supply rollers a to e thus produced, the metal shaft 15*a* has a diameter of 6 mm, and the sponge layer 15*b* has a thickness of 4.75 mm.

An experiment was conducted for evaluating image quality. In the experiment, the developing device 22 was formed of one of the developing rollers A to E and one of the toner supply rollers a to e, thereby constituting samples 1 to 7 and comparative samples 1 to 6 as shown in Table 1 and Table 2.

TABLE 1

| | Developing roller | | | | Toner supply roller | |
|---|---|---|---|---|---|---|
| | Roller | Ra (μm) | SFE (mN/m) | Charge supply ability (μC/g) | Roller | Hardness Haf (°) |
| Sample 1 | A | 0.6 | 26 | −7 | b | 56 |
| Sample 2 | A | 0.6 | 26 | −7 | d | 24 |
| Sample 3 | B | 0.4 | 22 | −21 | b | 56 |
| Sample 4 | B | 0.4 | 22 | −21 | c | 29 |
| Sample 5 | B | 0.4 | 22 | −21 | d | 24 |
| Sample 6 | C | 0.1 | 15 | −29 | b | 56 |
| Sample 7 | C | 0.1 | 15 | −29 | d | 24 |

TABLE 2

| | Developing roller | | | | Toner supply roller | |
|---|---|---|---|---|---|---|
| | Roller | Ra (μm) | SFE (mN/m) | Charge supply ability (μC/g) | Roller | Hardness Haf (°) |
| Comparative Sample 1 | A | 0.6 | 27 | −7 | a | 65 |
| Comparative Sample 2 | E | 0.6 | 31 | −8 | b | 56 |
| Comparative Sample 3 | D | 0.7 | 26 | −7 | b | 56 |
| Comparative Sample 4 | D | 0.6 | 26 | −7 | e | 15 |
| Comparative Sample 5 | C | 0.1 | 15 | −29 | e | 15 |
| Comparative Sample 6 | F | 0.1 | 14 | −29 | e | 15 |

In the experiment, in order to obtain the centerline average roughness Ra as a calculated average surface roughness, a surface roughness of the developing rollers A to E (in a circumferential direction) was measured with an contour shape tester (Surfcoder SEF3500, a product of Kosaka Laboratory Ltd.) in compliance with JIS B0601:1994. The centerline average roughness Ra was determined from a sectional contour of the roller taken along a plane perpendicular to undulation of the roller. More specifically, a portion having a standard length was taken out from a sectional curve along an average line direction. Then, the centerline average roughness Ra was obtained from a roughness curve represented through taking X of the portion in the average line direction and Y of the portion in a vertical multifunction direction.

In the experiment, in order to obtain the surface free energy SFE, after the developer rollers A to E were placed for one day under a printing environment of a temperature of 23° C. and a relative humidity of 45%, droplets of water, di-iodine methane, and ethylene-glycol were dropped on the surfaces of the developer rollers A to E. A contact angle of the droplet was directly measured with a contact angle meter (CA-X, a product of Kyowa Interface Science Co., Ltd.). Accordingly, the surface free energy SFE including a variance component and a polarity component was obtained through inserting the contact angle of each liquid into a regression expression derived from Owens & Wendt equation.

In the experiment, the charge supply ability (triboelectrification of toner) represents ability of the developing roller 14 in supplying charges with respect to the toner 16. The toner 16 uniformly slid against the material constituting the surface layer 14*c* to evaluate the charge supply ability. More specifically, the material constituting the surface layer 14*c* sandwiched the toner 16 having a thickness of 50 μm per 1 $cm^2$, and rubbed the toner 16 with a load of 300 gf. When the load increased, the charge supply ability increased.

In order to measure the saturated charge amount of the toner 16, 4 wt % of the toner 16 and 96 wt % of silicone coated ferrite carrier (a product of Kanto Denka Kogyo Co., Ltd.) were mixed with a ball mill for one minute. Then, the saturated charge amount of the toner 16 was measured with Q/M Meter Model 210HS (a product of Trek Corp.)

A toner charge amount Q/M was a charge amount of the toner 16 forming a toner layer on the developing roller 14 after passing the developing blade 17 and just before being attached to the photosensitive drum 11. The toner charge amount Q/M was measured with Q/M Meter Model 210HS (a product of Trek Corp.). A unit of the toner charge amount Q/M is μC/g (charge amount/unit weight).

In the experiment, in order to measure a toner transport amount M/A, the toner 16 forming the toner layer on the developing roller 14 after passing the developing blade 17 and just before being attached to the photosensitive drum 11 was transferred to a tape. A weight (mg) per unit area (1 $cm^2$) of the toner 16 was measured as the toner transport amount M/A.

In the experiment, in order to evaluate the image quality, an optical LED type color electro-photography printer MICROLINE 5900dn (a product of OKI DATA Corporation, resolution of 600 dpi) was used. The printing environment was set at a temperature of 23° C. and a relative humidity of 45%.

In the experiment, in order to evaluate the image quality, the printing operation was performed using a 100% density pattern, and a density of an image was measured with X-Rite 528 (a product of X-Rite Corp.), thereby obtaining a density OD. The density OD had a lower limit of 1.1 for obtaining image quality satisfactory for practical use.

Figure 4:
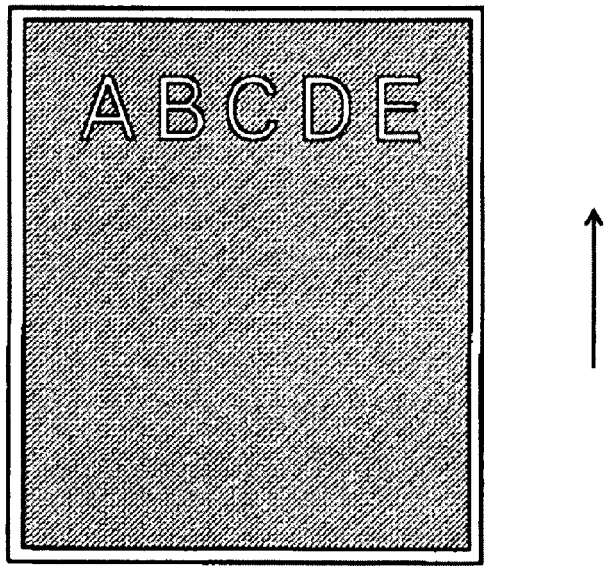
FIG. 4 is a schematic view showing a print result according to the first embodiment of the present invention.

An evaluation of an afterimage will be explained next. FIG. 4 is a schematic view showing a print result according to the first embodiment of the present invention.

As shown in FIG. 4, a print pattern has a portion of 100% density and empty portions with 0% density, i.e., characters A to E. The toner 16 is developed differently in the portion of 100% density and the portion with 0% density. Accordingly, a difference in a charged state of the toner 16 on the developing roller 14 becomes a good indicator of an influence on developing ability in the next operation. In the experiment, it was visually confirmed whether an afterimage was created in the portion with 0% density on a downstream side in a printing direction (indicated with an arrow in FIG. 4).

An evaluation of filming will be explained next. When a component rubs the toner 16 with a large load, the toner 16 tends to be deteriorated. Accordingly, it is difficult to maintain an initial state of the toner 16, thereby attaching to the developing roller 14 or the developing blade 17 and causing the filming. When the filming occurs, it is difficult for the developing blade 17 to form the toner layer with a uniform thickness on the developing roller 14, thereby causing an uneven image or a lateral streak, and lowering image quality. In the experiment, 10,000 sheets were printed (durable printing), and it was visually confirmed whether an uneven image or a lateral streak was generated.

An evaluation result of the image quality will be explained next. Table 3 shows the evaluation result of the image quality of the samples 1 to 7.

TABLE 3

| | Charge | Density | | | Filming 10,000 |
|---|---|---|---|---|---|
| | amount (μC/g) | OD | Result | Afterimage | sheets |
| Sample 1 | −22 | 1.19 | Good | Good | Good |
| Sample 2 | −18 | 1.15 | Good | Good | Good |
| Sample 3 | −24 | 1.24 | Good | Good | Good |
| Sample 4 | −22 | 1.22 | Good | Good | Good |
| Sample 5 | −17 | 1.17 | Good | Good | Good |
| Sample 6 | −19 | 1.3 | Good | Good | Good |
| Sample 7 | −15 | 1.22 | Good | Good | Good |

In the samples 1 and 2, the developing roller 14 has the large values of the centerline average roughness Ra and the surface free energy SFE, and was able to scrape off the toner, so that the afterimage showed the good result. Further, even though the developing roller 14 has low charge supply ability (−7 μC/g), the developing roller 14 showed relatively large values of the toner charge amount Q/M, i.e., the good result. Accordingly, the density OD were 1.19 and 1.15, respectively, i.e., the good result. Further, the filming was the good result.

In the samples 3 to 5, the developing roller 14 has the relatively medium values of the centerline average roughness Ra and the surface free energy SFE, and was able to scrape off the toner, so that the afterimage showed the good result. Further, the developing roller 14 has relatively medium charge supply ability (−21 μC/g), and showed relatively large values of the toner charge amount Q/M, i.e., the good result. Accordingly, the density OD were 1.24, 1.22, and 1.17, respectively, i.e., the good result. Further, the filming was the good result.

In the samples 6 and 7, the developing roller 14 has the small values of the centerline average roughness Ra and the surface free energy SFE, and was able to scrape off the toner, so that the afterimage showed the good result. Further, the developing roller 14 has high charge supply ability (−29 μC/g), and showed relatively large values of the toner charge amount Q/M, i.e., the good result. Accordingly, the density OD were 1.30 and 1.22, respectively, i.e., the good result. Further, the filming was the good result.

Table 4 shows the evaluation result of the image quality of the comparative samples 1 to 6.

TABLE 4

| | Charge | Density | | | Filming 10,000 |
|---|---|---|---|---|---|
| | amount (μC/g) | OD | Result | Afterimage | sheets |
| Comparative sample 1 | −24 | 1.25 | Good | Good | Poor |
| Comparative sample 2 | −25 | 1.24 | Good | Poor | Good |
| Comparative sample 3 | −30 | 1.28 | Good | Poor | Good |
| Comparative sample 4 | −15 | 0.99 | Poor | Poor | Good |
| Comparative sample 5 | −9 | 1.17 | Good | Poor | Good |
| Comparative sample 6 | −10 | 1.08 | Poor | Poor | Good |

In the comparative sample 1, even though the developing roller 14 has a low value of the charge supply ability, the developing roller 14 showed a relatively large value of the toner charge amount Q/M. Accordingly, the density OD was 1.25, i.e., the good result. However, the toner 16 was deteriorated excessively, and the filming was not the good result.

In the comparative sample 2, the developing roller 14 has a large value of the surface free energy SFE. Accordingly, it was difficult to scrape off the toner 16 remaining on the developing roller 14, and the afterimage was not the good result.

In the comparative sample 3, the developing roller 14 has a large value of the centerline average roughness Ra. Accordingly, it was difficult to scrape off the toner 16 remaining on the developing roller 14, and the afterimage was not the good result.

In the comparative sample 4, the developing roller 14 has large values of the surface free energy SFE and the centerline average roughness Ra. Accordingly, it was difficult to scrape off the toner 16 remaining on the developing roller 14, and the afterimage was not the good result. Further, the developing roller 14 has a low value of the charge supply ability, so that the developing roller 14 did not show a large value of the toner charge amount Q/M, i.e., the poor result. The density OD showed a low value, thereby obtaining the poor result.

In the comparative sample 5, the developing roller 14 has small values of the surface free energy SFE and the centerline average roughness Ra. However, the hardness Hsf of the toner supply roller 15 is low. Accordingly, it was difficult to scrape off the toner 16 remaining on the developing roller 14, and the afterimage was not the good result.

In the comparative sample 6, the developing roller 14 has small values of the surface free energy SFE and the centerline average roughness Ra. Especially, the surface free energy SFE is lower than that of the comparative example 5. However, the hardness Haf of the toner supply roller 15 is low. Accordingly, it was difficult to scrape off the toner 16 remaining on the developing roller 14, and the afterimage was not the good result. The density OD showed a low value, thereby obtaining the poor result.

As described above, in the embodiment, the developing roller 14 has the surface having the centerline average surface roughness Ra between 0.1 μm and 0.6 μm, and the surface free energy SFE between 15 mN/m and 26 mN/m. Further, the toner supply roller 15 has the Asker F hardness Haf between 24° and 56°. Accordingly, it is possible to prevent the afterimage from occurring and obtain the sufficient density OD. Note that the developing roller 14 has the charge supply ability between −29 μC/g and −7 μC/g. That is, it is possible to prevent the afterimage from occurring, as well as transport a sufficient amount of the toner, thereby obtaining the sufficient image density.

As described above, in the embodiment, the sponge layer 15 is formed of the polyurethane soft slab foam.

Figure 5:
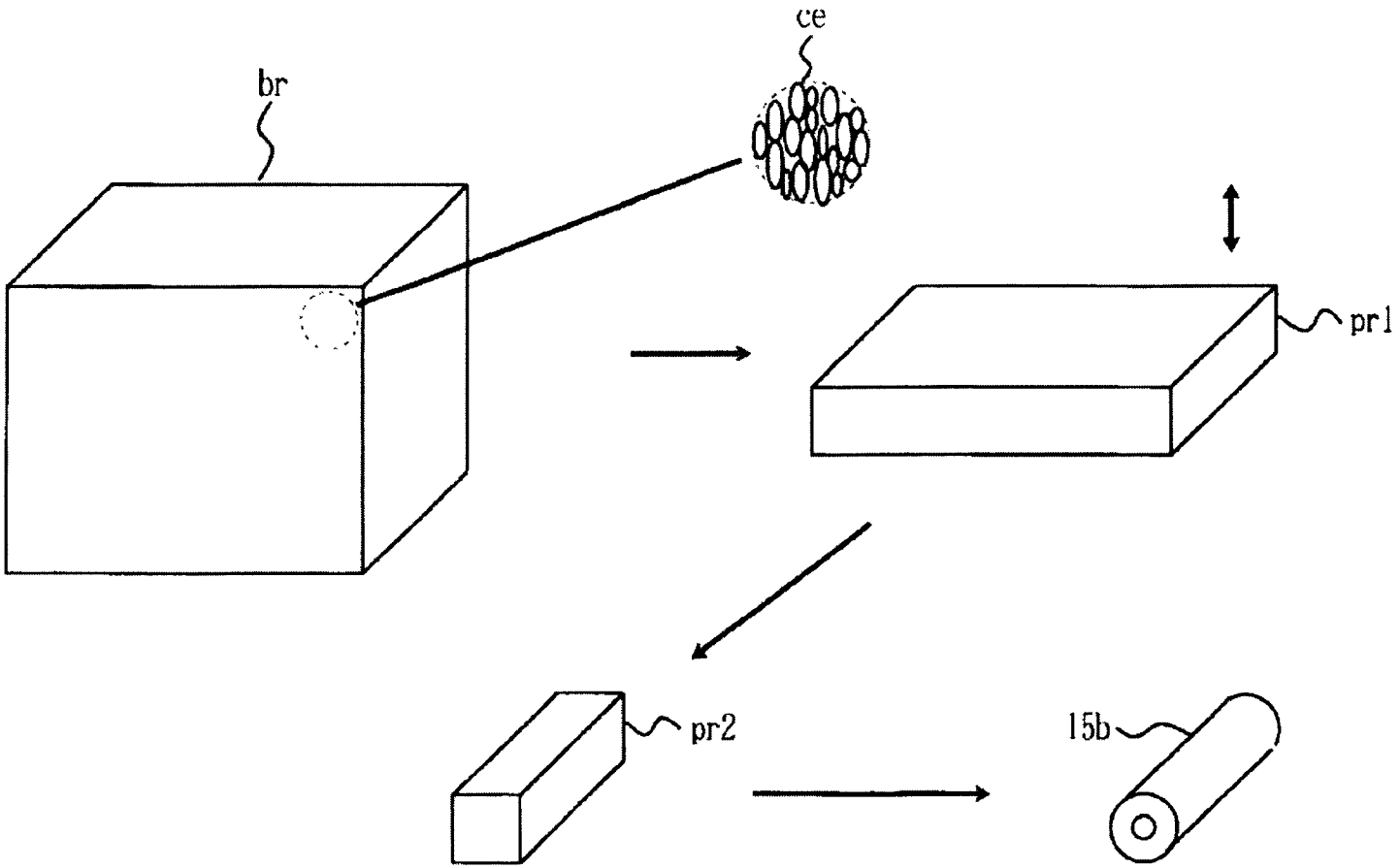
FIG. 5 is a schematic view showing a manufacturing process of a sponge layer according to the first embodiment of the present invention.
Figure 6:
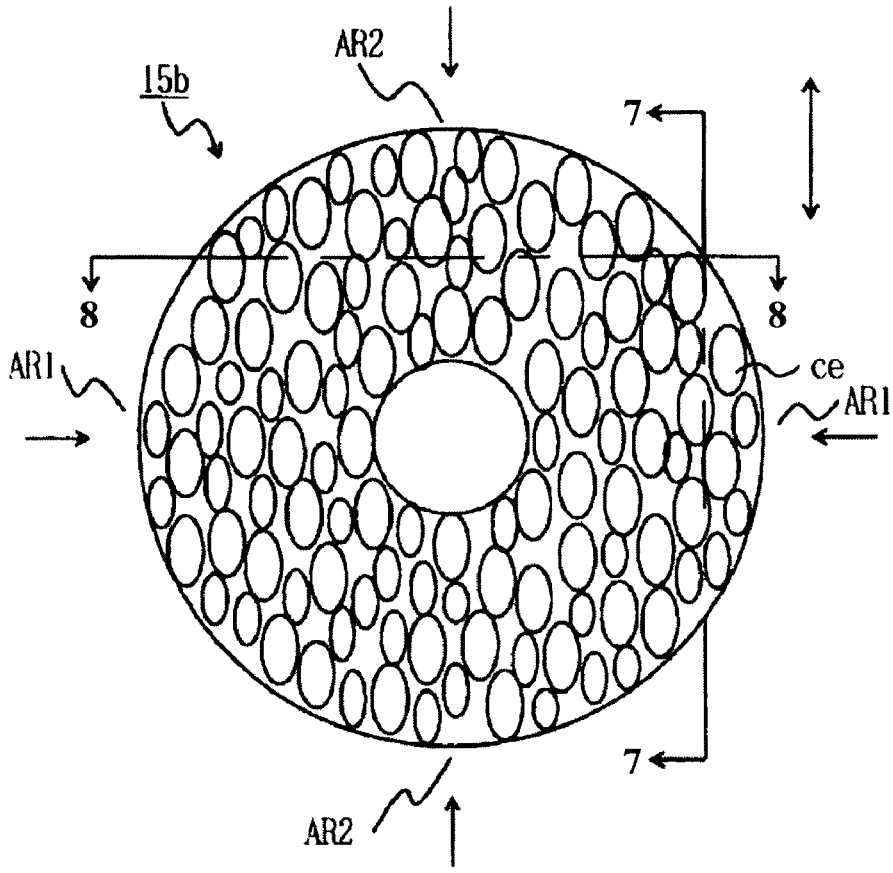
FIG. 6 is a schematic sectional view showing the sponge layer according to the first embodiment of the present invention.
Figure 7:
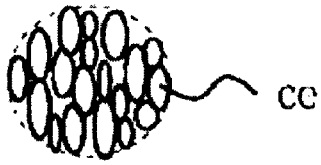
FIG. 7 is a schematic sectional view taken along a line 7-7 in FIG. 6 according to the first embodiment of the present invention.
Figure 8:
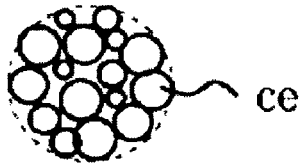
FIG. 8 is a schematic sectional view taken along a line 8-8 in FIG. 6 according to the first embodiment of the present invention.

FIG. 5 is a schematic view showing a manufacturing process of the sponge layer 15*b* according to the first embodiment of the present invention. FIG. 6 is a schematic sectional view showing the sponge layer 15*b* according to the first embodiment of the present invention. FIG. 7 is a schematic sectional view taken along a line 7-7 in FIG. 6 according to the first embodiment of the present invention. FIG. 8 is a schematic sectional view taken along a line 8-8 in FIG. 6 according to the first embodiment of the present invention.

As shown in FIG. 5, the polyurethane soft slab foam br is produced through an open foaming on a foaming conveyer. The polyurethane soft slab foam br has a foam structure formed of cells having an oval shape extending vertically in a foaming direction.

In the embodiment, the polyurethane soft slab foam br is cut in a direction perpendicular to the foaming direction to obtain a plate member pr1, and then the plate member pr1 is cut in a direction in parallel to the foaming direction to obtain a rectangular member pr2. At last, the rectangular member pr2 is punched to obtain the sponge layer 15*b*.

As shown in FIGS. 6 and 7, in areas AR1 in an outer circumferential surface of the sponge layer 15*b*, cells ce have an oval sectional shape corresponding to a long diameter of an oval portion. As shown in FIGS. 6 and 8, in areas AR2 away from the areas AR1 along the outer circumference by 90°, cells ce have a circular sectional shape corresponding to a short diameter of the oval portion. In other words, the cells ce have a shape changing from the circular one to the oval one according to an angle along the outer circumferential surface of the sponge layer 15*b*. Note that FIGS. 6 to 8 schematically show the cells ce having the circular shape or the oval shape, and actual shapes vary.

When the cells ce have a shape changing according to an angle along the outer circumferential surface of the sponge layer 15*b*, a shape and a capacity of surface undulation of the sponge layer 15*b* change as well. Further, the cells ce have the oval sectional shape in the areas AR1, so that a hardness of the cells ce increases. That is, in addition to the hardness, a physical property changes along the outer circumferential direction. Accordingly, when the toner supply roller 15 rotates, the toner supply roller 15 pushes the developing roller 14 with various reaction forces, so that the toner supply roller 15 abuts against the developing roller 14 with various pressures. As a result, the toner charge amount Q/M of the toner 16 tends to be unstable, and the density OD tends to be uneven according to the rotation of the toner supply roller 15.

Second Embodiment

A second embodiment of the present invention will be explained next. In the second embodiment, it is possible to prevent the density OD from being uneven according to the rotation of the toner supply roller 15. Components in the second embodiment similar to those in the first embodiment are designated with the same reference numerals, and explanations thereof are omitted.

Figure 9:
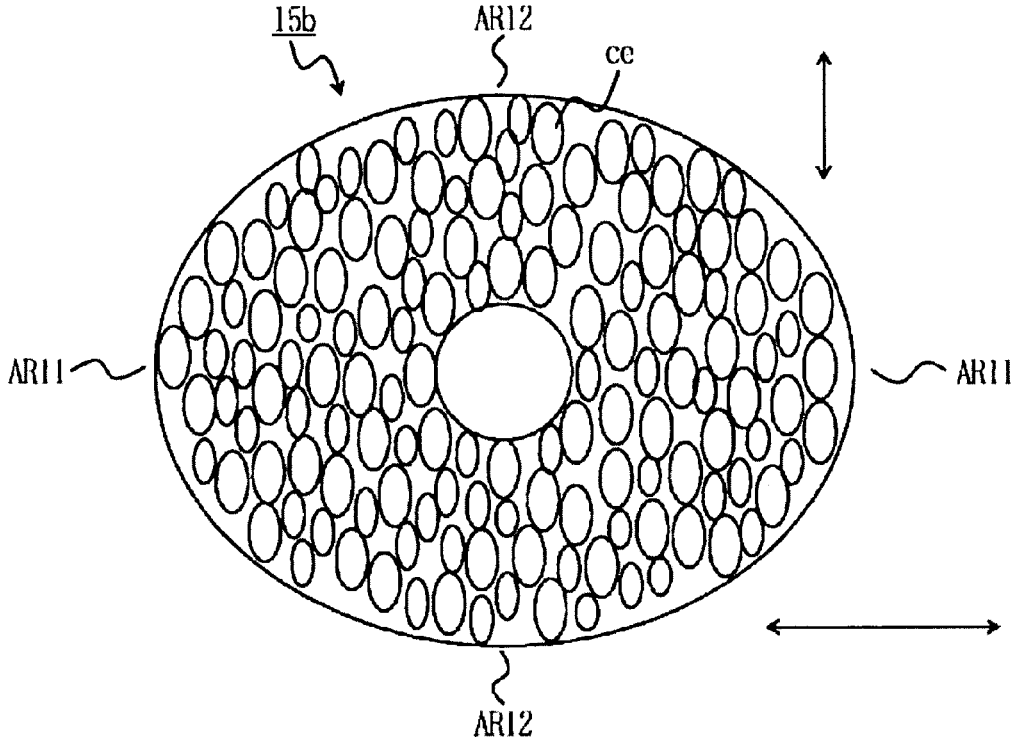
FIG. 9 is a schematic sectional view showing a sponge layer according to a second embodiment of the present invention.

FIG. 9 is a schematic sectional view showing the sponge layer 15*b* according to the second embodiment of the present invention.

A method of producing the toner supply roller 15 as the developer supply member and the developer charging member will be explained next. A punch mold having an oval shape is prepared. After the punch mold is placed such that a long diameter of the punch mold is aligned between areas AR11, where the cells ce have the oval sectional shape, and a short diameter of the punch mold is aligned between areas AR12, where the cells ce have the circular sectional shape. Then, the rectangular member pr2 of the polyurethane soft slab foam (refer to FIG. 5) is punched out to obtain the sponge layer 15*b* of the toner supply roller 15. In this case, the rectangular member pr2 constitutes a base member.

An experiment was conducted for evaluating the image quality. After the sponge layer 15*b* punched out from the rectangular member pr2 of the polyurethane soft slab foam was inserted into the metal shaft 15*a*, the polyurethane soft slab foam was attached to form in a roll shape. In the next step, similar to the toner supply rollers a to e, the sponge layer 15*b* was immersed in the conductive resin solution and dried, thereby obtaining toner supply rollers f to h.

In the toner supply roller f, the metal shaft 15*a* had a diameter of 6 mm, and an outer diameter of the toner supply roller f is 13.5 mm. The toner supply roller f had the Asker F hardness Haf of 28° in a direction in parallel to the foaming direction of the cells ce and 21° a direction perpendicular to the foaming direction of the cells ce, so that a hardness difference along a circumferential direction was 7°.

In the toner supply roller g, the metal shaft 15*a* had a diameter of 6 mm. An outer diameter in a direction in parallel to the foaming direction of the cells ce was 13.5 mm, and an outer diameter in a direction perpendicular to the foaming direction of the cells ce is 13.8 mm. The toner supply roller g had the Asker F hardness Haf of 28° in a direction in parallel to the foaming direction of the cells ce and 24° a direction perpendicular to the foaming direction of the cells ce, so that a hardness difference along a circumferential direction was 4°.

In the toner supply roller h, the metal shaft 15*a* had a diameter of 6 mm. An outer diameter in a direction in parallel to the foaming direction of the cells ce was 13.5 mm, and an outer diameter in a direction perpendicular to the foaming direction of the cells ce is 14.0 mm. The toner supply roller h had the Asker F hardness Haf of 28° in a direction in parallel to the foaming direction of the cells ce and 27° a direction perpendicular to the foaming direction of the cells ce, so that a hardness difference along a circumferential direction was 1°.

In the experiment, the developing device 22 was formed of the developing roller A and one of the toner supply rollers f to h, thereby constituting samples 8 and 9 and a comparative sample 7 as shown in Table 5 and Table 6. The result of the evaluation is shown in Table 7 and Table 8.

TABLE 5

| | Developing roller | | | | Toner supply roller | |
|---|---|---|---|---|---|---|
| | Roller | Ra (μm) | SFE (mN/m) | Charge supply ability (μC/g) | Roller | Hardness Haf (°) |
| Sample 8 | A | 0.6 | 26 | −7 | g | 26 ± 2 |
| Sample 9 | A | 0.6 | 26 | −7 | h | 27.5 ± 0.5 |

TABLE 6

| | Developing roller | | | | Toner supply roller | |
|---|---|---|---|---|---|---|
| | Roller | Ra (μm) | SFE (mN/m) | Charge supply ability (μC/g) | Roller | Hardness Haf (°) |
| Comparative Sample 7 | A | 0.6 | 26 | −7 | f | 24 ± 2.5 |

TABLE 7

| | Charge amount (μC/g) | Density uniformity | Afterimage | Filming 10,000 sheets |
|---|---|---|---|---|
| Sample 1 | −20 | Good | Good | Good |
| Sample 2 | −19 | Good | Good | Good |

TABLE 8

| | Charge amount (μC/g) | Density uniformity | Afterimage | Filming 10,000 sheets |
|---|---|---|---|---|
| Comparative Sample 7 | −20 | Poor | Good | Good |

In the samples 8 and 9 and the comparative sample 7, only the developing roller A with the low charge supply ability (−7 μC/g) was used. Note that the developing rollers B and C tend to have large values of the toner charge amount Q/M. Accordingly, it was difficult to evaluate the density uniformity of the toner supply roller 15. For the reason, the developing rollers B and C were not used in the experiment.

In the samples 8 and 9, the density uniformity was good, and the afterimage did not occur. Further, the filming was the good result. On the other hand, in the comparative, although the afterimage did not occur, the density became uneven due to a circumferential variance of the toner supply roller 15.

As described above, when the toner supply roller 15 has the hardness difference along the circumferential direction is less than 4°, it is possible to obtain a good image without an uneven density due to a circumferential variance.

In the embodiments described above, the printer is explained as the image forming apparatus. The present invention is applicable to a copier, a facsimile, a multi-function product, and the likes.

The disclosure of Japanese Patent Application No. 2008-044077, filed on Jan. 23, 2008, is incorporated in the application.

While the invention has been explained with reference to the specific embodiments of the invention, the explanation is illustrative and the invention is limited only by the appended claims.

What is claimed is:

1. A developing device comprising:

a developer supporting member for supporting developer, said developer supporting member including a surface having a calculated average surface roughness Ra between 0.1 μm and 0.6 μm and a surface free energy SFE between 15 mN/m and 26 mN/m; and a developer charging member disposed to face the developer supporting member for charging and supplying the developer to the developer supporting member, said developer charging member having an Asker F hardness Haf between 24° and 56°.

2. The developing device according to claim 1, wherein said developer supporting member and said developer charging member are formed of rotational members being disposed to form an overlap portion therebetween.

3. The developing device according to claim 1, wherein said developer charging member includes an outer circumferential surface formed of a foam layer, said developer charging member having a difference in an Asker F hardness Haf equal to or less than 4° along a circumferential direction thereof.

4. The developing device according to claim 1, wherein said developer supporting member having charge supply ability for supplying charges to the developer between −29 μC/g and −7 μC/g.

5. The developing device according to claim 1, wherein said developer supporting member is adopted to support the developer including toner.

6. The developing device according to claim 1, wherein said developer supporting member is formed of a developing roller.

7. The developing device according to claim 1, wherein said developer charging member is formed of a toner supply roller.

8. The developing device according to claim 6, wherein said developing roller is formed of a metal shaft, an elastic layer disposed on an outer circumference of the metal shaft, and a surface layer disposed on an outer circumference of the elastic layer.

9. The developing device according to claim 7, wherein said toner supply roller is formed of a metal shaft and an sponge layer disposed on an outer circumference of the metal shaft.

10. An image forming apparatus comprising the developing device according to claim 1.

* * * * *